United States Patent [19]

Muller

[11] Patent Number: 4,662,019

[45] Date of Patent: May 5, 1987

[54] METHOD OF ERECTING A CABLE STAYED BRIDGE

[75] Inventor: Jean M. Muller, Tallahassee, Fla.

[73] Assignee: Figg and Muller Engineers, Inc., Tallahassee, Fla.

[21] Appl. No.: 819,018

[22] Filed: Jan. 15, 1986

[51] Int. Cl.[4] ..... E01D 21/04

[52] U.S. Cl. ..... 14/1; 14/18; 14/21; 14/27; 14/77

[58] Field of Search ..... 14/2.6, 6, 18, 19, 20, 14/21, 23, 1, 27, 77; 52/745

[56] References Cited

U.S. PATENT DOCUMENTS

| | | | |
|---|---|---|---|
| 508,929 | 11/1893 | Fontaine | 14/2.6 |
| 1,850,507 | 3/1932 | Larsson | 14/1 |
| 3,570,207 | 3/1971 | Launay | 52/745 |
| 3,685,074 | 8/1972 | Marshall et al. | 14/18 X |

FOREIGN PATENT DOCUMENTS

| | | | |
|---|---|---|---|
| 1042068 | 9/1966 | United Kingdom | 14/1 |

*Primary Examiner*—James A. Leppink
*Assistant Examiner*—Matthew Smith
*Attorney, Agent, or Firm*—Watson, Cole, Grindle & Watson

[57] ABSTRACT

A cable stayed bridge is constructed as having approach deck spans and at least one cable stayed deck bridge section assembled as a unit by employing the deck surfaces of the approach spans as in situ work surfaces for erecting equal deck lengths of the unit. A bridge pylon is supported on a floatable support and extends through an open gap provided in an approach span deck, and cable stays are extended from the pylon for supporting the deck lengths. The completed unit is moved away from the work surfaces and into alignment with a last of the approach spans, and is permanently anchored in place.

6 Claims, 6 Drawing Figures

METHOD OF ERECTING A CABLE STAYED BRIDGE

BACKGROUND OF THE INVENTION

This invention relates generally to a cable stayed bridge having continuous approach and main spans, and more particularly to a method of erecting cable stayed deck bridge sections forming a main span by using the deck surfaces of previously constructed approach spans as work surfaces, and moving a completely assembled bridge section with its support pylon and cable stays, as a unit, from the work surfaces to the main span location as a continuation of the approach spans.

When erecting a cable stayed bridge, the approach spans are typically constructed on piers from the bridge abutments working toward the main span location after which the main span(s) continues in some manner working from the approach spans by, for example, cantilevering deck modules one from the other until the midspan is reached. Any number of different techniques are employed for the construction of a bridge having approach and main spans depending on whether the bridge is constructed of concrete and/or steel, and the foregoing is one example. However, constructing the main span from the opposite approach spans using either the cantilever technique or a more conventional technique requiring construction equipment from floating barges, the cable stayed main span construction can be quite time consuming and oftentimes requires special construction and handling equipment, depending on the construction technique employed.

SUMMARY OF THE INVENTION

The method employed according to the invention avoids the need for special construction and handling equipment, and significantly reduces the time and expense in erecting the main span or spans of a cable stayed bridge. This is the principal objective of the invention.

Specifically, approach spans are constructed in some manner over piers from the bridge abutment until the main span location is reached at which a cable stayed deck bridge section is to be located. An open gap is left in one of the approach spans a distance from the end of the last approach span greater than half the length of the cable stayed bridge section to be constructed, and a bridge pylon is temporarily supported below such gap and extends therethrough a predetermined distance above the approach spans to the normal height required. The approach spans which adjoin opposite sides of the gap are employed as in situ work surfaces as equal deck lengths of the cable stayed bridge section are assembled directly on such work surfaces, and such lengths are connected together by a mid-section overlying the gap. As the equal lengths are being assembled, they are supported from the pylon with cable stays extending therefrom and anchored to the deck lengths at spaced designated locations. The cable stayed bridge section, which is now completely assembled, is then moved transversely together with its pylon and cable stays as a unit, away from and clear of the approach spans, after which it is moved as a unit to the main span location as a continuation of the last approach span. The unit is then permanently supported by its pylon at the main span location.

The pylon may be temporarily supported on a floatable support resting on the bed of a body of water which the bridge spans, such that the unit is moved by floating such support for lifting the cable stayed bridge section from the work surfaces, and for moving the bridge section to the main span location, after which the pylon is lowered onto a permanent foundation at the main span location.

DETAILED DESCRIPTION OF THE INVENTION

Figures 1, 2, 3, 4, 5:
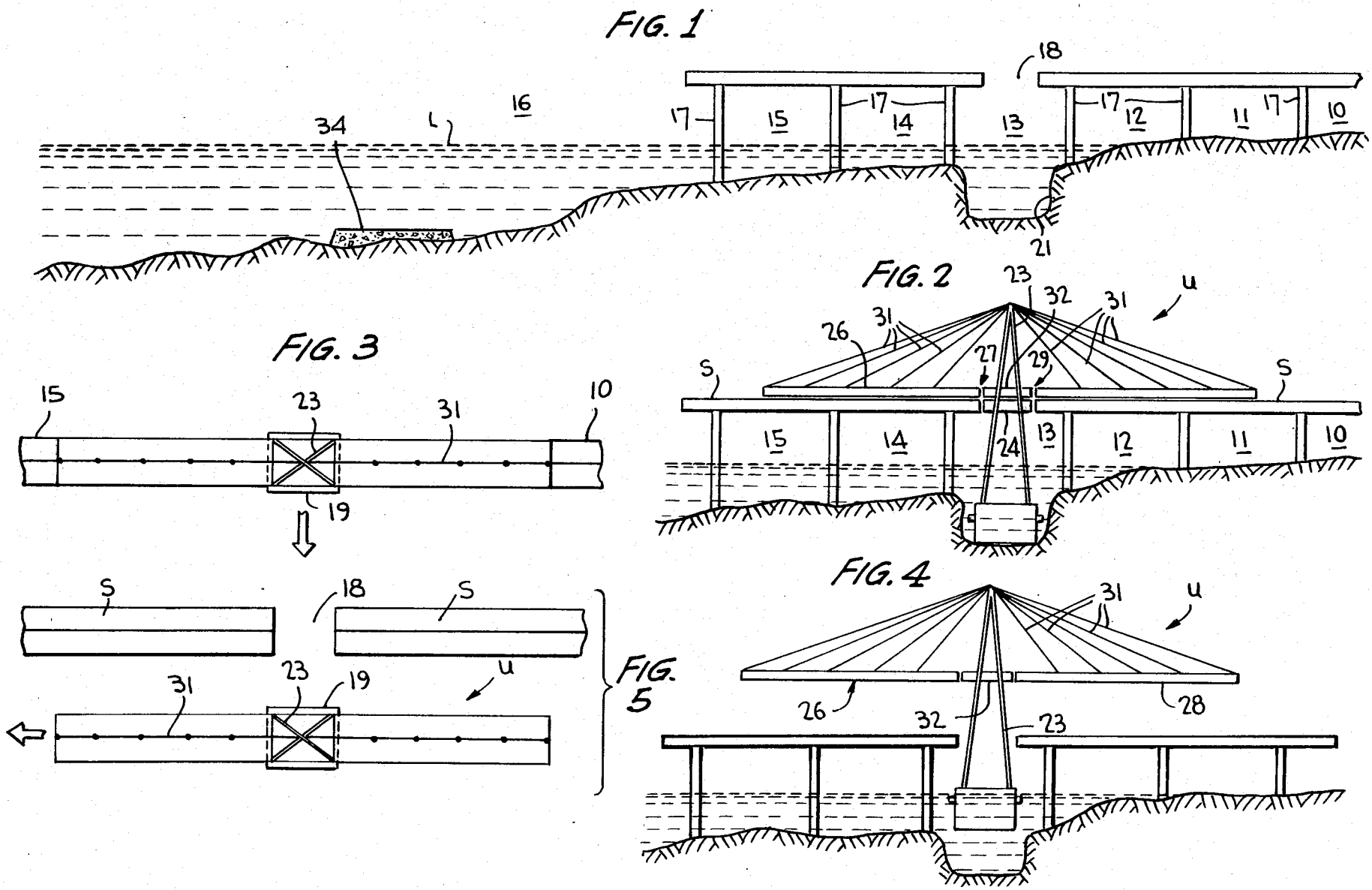
FIG. 1 is a schematic illustration in side elevation of the approach spans constructed prior to erecting a cable stayed bridge section.
FIG. 2 is a view similar to FIG. 1 showing the bridge section after it is completely assembled using the approach spans as work surfaces.
FIG. 3 is a top view of the FIG. 2 bridge section relative to the approach spans.
FIG. 4 is a view similar to FIG. 2 showing the completed cable stayed bridge section after having been transversely moved as a unit clear of the approach spans.
FIG. 5 is a top view of the FIG. 4 unit.

Turning now to the drawings wherein like reference characters refer to like and corresponding parts throughout the several views, FIG. 1 shows continuous approach deck spans 10–15, etc., of some type after having been constructed in some manner, forming no part of the invention, from the bridge abutment (not shown) until the last approach span 15 is reached at a main span location 16. The approach spans are constructed on and supported by spaced piers 17, several of which being shown as supported from bed B below level L of a body of water which the completed bridge is intended to span. During the approach span construction, an open gap 18 is maintained in span 13, this gap being spaced from the free end of span 15 a distance greater than one-half the length of the cable stayed bridge section to be constructed.

Although not shown, approach spans are similarly constructed, as shown in FIG. 1, from the opposite bridge abutment toward the bridge midspan, such that cable stayed deck bridge sections may be simultaneously assembled on the approach span decks at opposite shores, by the method now to be described.

A floatable support 19, such as a caisson, is lowered in place for resting on bed B of the body of water directly beneath gap 18 and within a ditch 21 which may need to be excavated for this purpose. The support lies along the longitudinal centerline of the approach deck spans (FIG. 3), and may be lowered in place by pumping the caisson with water through valves 22 while exhausting air, as in any normal manner forming no part of this invention.

A bridge pylon 23, which may be of pyramidal shape having a rectangular base and of precast concrete and/or steel, may be erected on support 19 before the support is floated and lowered in place as aforedescribed. Otherwise, the pylon may be erected on support 19 after it is lowered in place. In any event, the pylon extends through gap 18 and above the deck surfaces of the approach spans a normal distance required for a typical bridge pylon of a cable stayed bridge. An approach span deck section 24 may be erected and supported directly on the pylon for temporarily closing gap 18 so as to facilitate the movement of bridge elements 25 and equipment (not shown) across the gap.

Such bridge elements 25 may be conveniently transported along the approach span deck in the direction of the arrow of FIG. 2, using wheeled dollies or the like, or other simple construction equipment for assembling the cable stayed bridge section directly on the approach span deck surfaces S located on opposite sides of the gap which is now temporarily closed. An equal length deck portion 26 may be first assembled of interconnected bridge deck elements 25 which may comprise precast concrete box girders, either one wide or several wide, similar to that described in my U.S. application Ser. No. 803,669, filed Dec. 2, 1985, entitled "Method Of Constructing The Approach And Main Spans Of A Cable Stayed Segmental Bridge", or described in my U.S. application Ser. No. 823,660, filed 1-29-86 as a continuation-in-part of Ser. No. 803,669 and entitled "Method of Constructing A Cable Stayed Segmental Bridge." Of course, other bridge modules or deck elements may be employed, and portion 26 may be assembled starting at a location 27 adjacent the closed gap and proceeding toward its terminal end. Similarly, an equal length deck portion 28 is constructed of modules or bridge deck elements 25 starting at location 29 and proceeding toward its terminal end. During the process of assembling the equal length portions 26 and 28, a plurality of cable stays 31 are transported over the approach spans from land, and are extended from the pylon and anchored to deck portions 26 and 28 for supporting them from the bridge pylon. At some convenient time during the aforedescribed process of constructing the cable stayed bridge section, a mid-section 32 is extended between locations 27 and 29 of the assembled portions for completing the cable stayed bridge section. It can be therefore seen that the deck of the approach spans in the vicinity of gap 18 conveniently provide in situ work surfaces for assembling together the deck and cable stays which form an assembled unit U of a complete cable stayed bridge section.

It is to be pointed out that the bridge pylon can be of a different construction from that shown, and the cable stays may be differently arranged, without departing from the scope of the invention. For example, the cable stays may lie in a pair of spaced vertical planes extending from a central pylon, or extending from spaced pylons at opposite sides of the bridge, or the cable stays may be arranged parallel to one another rather than in a fan-shaped array.

After completion of assembled unit U shown in FIG. 2, caisson support 19 is elevated from water bed B by, for example, expelling water out through valves 22 thereof, and admitting air into the caisson therethrough, in some typical manner forming no part of this invention. Thus, portions 26, 28 and mid-section 32 are elevated from the approach spans on which they were assembled, and the entire support 19, bridge pylon, assembled bridge deck and supporting cable stays are moved, as a unit U, as with the use of tugboats, or other equipment, from the FIGS. 2, 3 position transversely away from and clear of the approach spans in the direction of the arrow of FIG. 3 to the position of FIGS. 4, 5. This completed unit U is then moved longitudinally, as with the use of tugboats or other equipment, from the FIGS. 4, 5 position in the direction of the arrow of FIG. 5 and transversely to the FIG. 6 position into transverse alignment with approach span 15. In this position, floatable support 19 overlies a permanent concrete foundation 34 previously installed at an appropriate position and at a given elevation. Support 19 is then flooded by admitting water through its valves 22 and expelling the air therethrough so as to lower the support onto foundation 34 such that portion 28 is in vertical alignment with the adjoining approach span 15.

Another cable stayed bridge section may then be erected in the same manner as aforedescribed employing approach spans 11–15 as in situ work surfaces, and forming a completely assembled unit U', whereafter U' will be shifted as aforedescribed first transversely away from the approach span work surfaces longitudinally and again transversely in place and aligned with deck portion 26 of unit U (FIG. 6) after which it is lowered in place on its foundation. Depending on the number of units U to be erected, further cable stayed bridge sections are assembled all as aforedescribed and moved into alignment with previously installed units. After the last of such units are so erected and installed, the joints between them and their adjoining approach spans are completed, and a permanent approach span section 35 is installed for closing gap 18.

Figure 6:
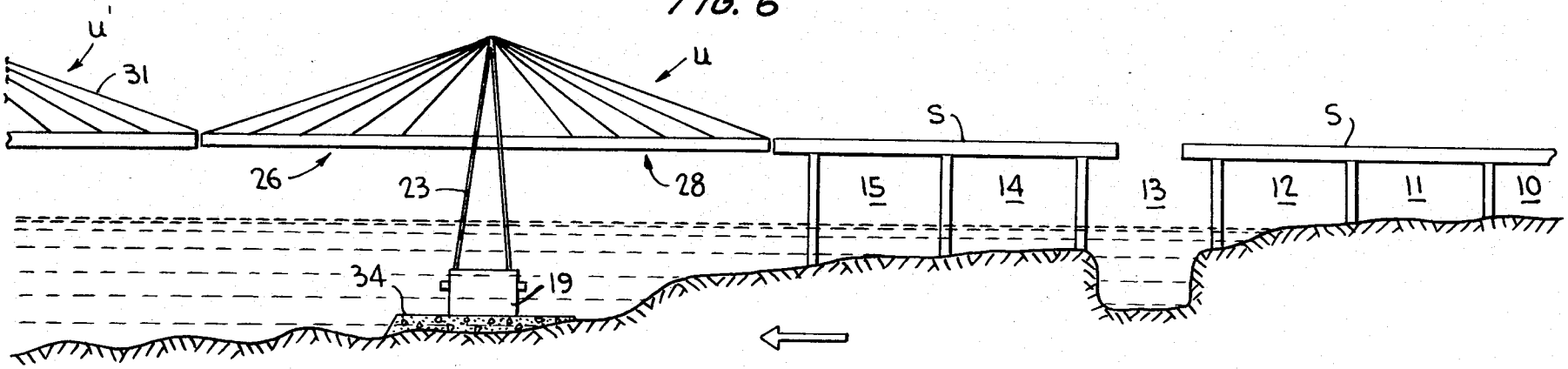
FIG. 6 is a view similar to FIG. 1 showing the cable stayed bridge section after having been moved into place as a continuation of the approach spans.

It should be noted that the elevation of each foundation 34 is such that the appropriate vertical alignment can be effected for the unit when moved and lowered into the FIG. 6 position, and shims or the like may be employed between support 19 and the foundation, or between the base of pylon 23 and support 19, for fine vertical adjustment.

From the foregoing, it can be seen that the main span or spans of a cable stayed bridge can be erected by employing already constructed approach spans, leading from the bridge abutment and out into the water as in situ work surfaces for completing the deck portions of the cable stayed bridge section. The cable stays may be appropriately tensioned at these work surfaces, and the longitudinal and transverse tendons (not shown) of the modules or elements forming the deck portions can be all tensioned at the approach span work surfaces, such that it only remains to complete the joints between respectively deck portions 26 and 28 and the adjoining bridge sections after the main span is moved into place.

Obviously, many modifications and variations of the present invention are made possible in the light of the above teachings. It is therefore to be understood that within the scope of the appended claims the invention may be practiced otherwise than as specifically described.

What is claimed is:

1. A method of erecting a cable stayed bridge having approach deck spans and at least one main deck span, comprising:

constructing a plurality of said approach spans on spaced piers from one end of a bridge abutment until a main span location is reached;

during said construction step, providing an open gap in the deck of one of said approach spans at a predetermined distance from the end of a last of said approach spans;

assembling together a cable stayed bridge section as a unit, said assembling step comprising the steps of temporarily supporting a bridge pylon below said one approach span and extending said pylon through said gap a predetermined distance above said approach spans;

the decks of said approach spans, lying on opposite sides of said gap, being employed as in situ work surfaces by erecting equal deck lengths of said bridge section directly on said work surfaces at said opposite sides of said gap;

connecting together said equal lengths by constructing a mid-section over said gap between confronting ends of said lengths;

supporting said equal deck lengths, during the erecting thereof, from said pylon by extending a plurality of cable stays between said pylon and said deck lengths, and anchoring said stays to said deck lengths at spaced designated locations;

raising said unit so as to elevate said deck lengths from said work surfaces;

transversely moving said elevated unit away from and clear of said approach spans;

moving said unit to said main span location as a continuation of said last approach span; and aligning one of said deck lengths, vertically and transversely, with said last approach span;

permanently supporting said unit in place at said main span location; and continuing the erecting of said bridge from the other of said deck lengths.

2. The method according to claim 1, wherein said pylon is temporarily supported on a floatable support resting on the bed of a body of water which the bridge spans, said moving steps being carried out by floating said support for raising said unit and for moving said unit away from said approach spans and to said main span location, and comprising the further steps of providing a permanent foundation at said main span location, and lowering said support on to said foundation for permanently positioning said unit in place.

3. The method according to claim 2, wherein said floatable support comprises a caisson.

4. The method according to claim 1, comprising the further step of, during the assembly of said section, erecting on said pylon a temporary approach span section at said gap for extending said work surfaces across said gap.

5. The method according to claim 1, wherein said continuing step comprises assembling together another cable stayed bridge section as another unit by carrying out said steps thereof, repeating said moving, aligning and permanently supporting steps for said another unit.

6. The method according to claim 1, comprising the further step of permanently closing said gap by erecting an approach deck section thereacross.

* * * * *